US005727724A

United States Patent [19]

Dowling

[11] Patent Number: 5,727,724

[45] Date of Patent: Mar. 17, 1998

[54] METHOD AND APPARATUS FOR TRANSPORTING A WEB MATERIAL

[75] Inventor: John Joseph Dowling, Rollinsford, N.H.

[73] Assignees: Heidelberg Harris Inc., Dover, N.H.; Heidelberger Druckmaschinen AG, Heidelberg, Germany

[21] Appl. No.: 710,301

[22] Filed: Sep. 17, 1996

[51] Int. Cl.[6] ..... B65H 20/00

[52] U.S. Cl. ..... 226/181; 226/185

[58] Field of Search ..... 226/181, 185, 226/188, 194

[56] References Cited

U.S. PATENT DOCUMENTS

| | | | |
|---|---|---|---|
| 3,186,195 | 6/1965 | Braun | 226/181 |
| 3,282,486 | 11/1966 | Moss | 226/181 |
| 3,784,187 | 1/1974 | Takayanagi et al. | 270/64 |
| 4,061,260 | 12/1977 | Copp | 226/185 |
| 5,152,522 | 10/1992 | Yamashita | 226/185 |
| 5,326,011 | 7/1994 | Mager et al. | 226/181 |

*Primary Examiner*—William Stryjewski

*Attorney, Agent, or Firm*—Burns, Doane, Swecker & Mathis, LLP

[57] ABSTRACT

An apparatus for transporting web material, such as a folded paper web in a web-fed rotary printing press, is disclosed which includes a first nip roller having a first set of driven and non-driven wheels which are arranged side by side along a rotational axis of the first nip roller, and a second nip roller having a second set of driven and non-driven wheels arranged side by side along the rotational axis of the second nip roller. The wheels of the first and second nip rollers are arranged such that the driven wheels of the first roller are facing the non-driven wheels of the second roller, thereby forming a nip for receiving and conveying the material web.

19 Claims, 5 Drawing Sheets

METHOD AND APPARATUS FOR TRANSPORTING A WEB MATERIAL

BACKGROUND OF THE INVENTION

1. Field of the Invention

The present invention generally relates to a method and apparatus for transporting material such as a web. More particularly, the invention relates to transporting a folded paper web in a web-fed rotary printing press.

2. State of the Art

Devices, such as nip roller arrangements, are well known for pulling or drawing web material through a web-processing apparatus, such as a web-fed rotary printing press or a paper-production machine. In web-fed rotary printing presses, a nip roller arrangement is usually located in the former and folder section of the printing press, usually underneath a former board which applies a longitudinal fold to the printed paper-web.

For example, U.S. Pat. No. 3,784,187 discloses a folding apparatus for a web-fed rotary printing press which comprises groups of nip rollers arranged below first and second triangular former boards. The nip rollers pull the web downstream of the triangular former boards, so as to give tension to the web and to the folds of the web.

The nip rollers used in conventional nip roller arrangements of web-fed rotary printing presses often include a first driven roller which is made of rigid material, (e.g., steel or other metal) and a second, non-driven roller, which is covered with a resilient material (e.g., polyurethane). For transporting the web, the rigid roller is driven with a slightly higher speed than the web speed, and the tension applied to the web is controlled by the pressure between the driven and the non-driven nip roller. To increase tension in the web, the pressure between the two nip rollers is increased so that frictional force between the driven nip roller and the web is increased too.

As a result of the constant slip between the driven nip roller and the paper web, the nip rollers wear out very quickly. The wear of the nip rollers is increased when the driven nip roller is coated with a resilient material (for example rubber or polyurethane). Moreover, as a result of the slip between the nip rollers and the paper web, there is the danger of smearing the printed image. Further, there is the danger that changes in the web tension, in the form of small disturbances, are directly passed through the nip of the nip roller arrangement into the cutting sections or further folding sections of the printing press.

SUMMARY OF THE INVENTION

It is an object of the present invention to provide a method and apparatus for directly controlling web tension. Exemplary embodiments relate to a nip roller arrangement, which is easy to produce and assemble, which prevents the propagation of disturbances in the web tension into subsequent sections of the printing press, and which reduces wear of the nip rollers.

According to exemplary embodiments, a nip roller arrangement is provided for transporting web material, such as a folded paper web in a web-fed rotary printing press. Exemplary embodiments comprise a first nip roller having a first set of driven and non-driven wheels arranged side by side along a rotational axis of the first nip roller, and a second nip roller having a second set of driven and non-driven wheels arranged side by side along the rotational axis of the second nip roller, the wheels of the first and second nip rollers being arranged such that the driven wheels of said first roller face the non-driven wheels of the second roller to form a nip for receiving and conveying the web material.

According to another exemplary embodiment of the invention, the non-driven and/or the driven wheels of the first and second nip rollers are coated with a resilient material, such as any elastomer, including rubber or polyurethane.

According to still another exemplary embodiment of the invention, the driven wheels and/or non-driven wheels of the first and second nip rollers are formed of a rigid material, such as metal (e.g., steel).

Pursuant to a further embodiment of the invention, a diameter of the non-driven wheels of the first and second nip rollers is larger than the diameter of the driven wheels.

Further, according to exemplary embodiments, each nip roller comprises a central drive shaft extending through the center of the driven and non-driven wheels, to which the driven wheels are drivingly connected by means of a clamp mechanism. The non-driven wheels of the nip rollers can be supported on the central drive shaft by bearings. Additionally, the driven and/or non-driven wheels of the first and second nip rollers can be mounted axially immovable on the central drive shaft in accordance with exemplary embodiments of the invention.

According to another exemplary embodiment of the invention, the central drive shafts of the nip rollers are drivingly connected to each other by meshing gears, such that the rollers have essentially the same rotational speed.

Furthermore, according to exemplary embodiments, at least one of the nip rollers can be movably supported by bearings such that a width of the nip for receiving and conveying the material web can be adjusted. Such a feature can be used to render the circumferential speed of the driven wheels of the first and second nip rollers essentially equal to the speed of the web material.

BRIEF DESCRIPTION OF THE DRAWINGS

The present invention, together with additional objects and advantages thereof, will be best understood from the following description of exemplary embodiments when read in connection with the accompanying drawings, in which.

DETAILED DESCRIPTION OF THE PREFERRED EMBODIMENTS

Figure 1:
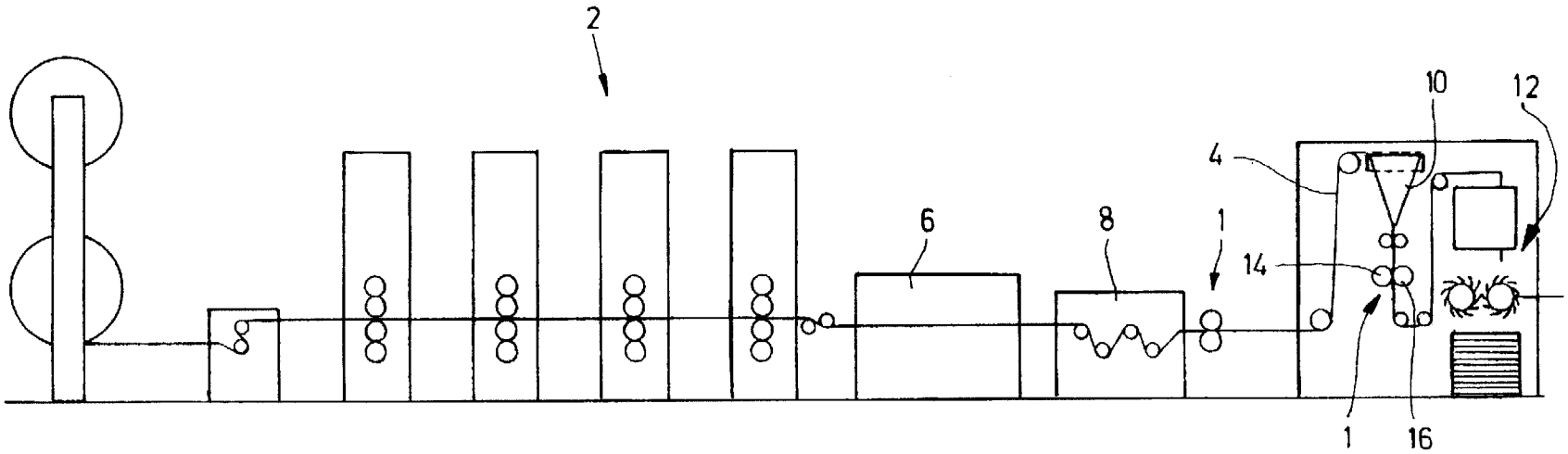
FIG. 1 is a schematic side view of a web-fed rotary printing press with a nip roller arrangement according to an exemplary embodiment of the present invention.

As shown in FIG. 1, an exemplary nip roller arrangement 1 for pulling a printed web 4 in an exemplary web-fed rotary printing press 2 is located downstream of a dryer section 6, a chill section 8 and/or a former board 10. The former board 10 is provided for longitudinally folding the printed web 4 before it is supplied to a downstream cutting section 12 for further processing.

Although the present invention is described herein with respect to a web-fed rotary printing press, it is also usable in other kinds of apparatuses for processing web material. For example, as those skilled in the art will appreciate, the present invention is equally applicable to paper processing machines, such as paper production machines and so forth.

Figure 2:
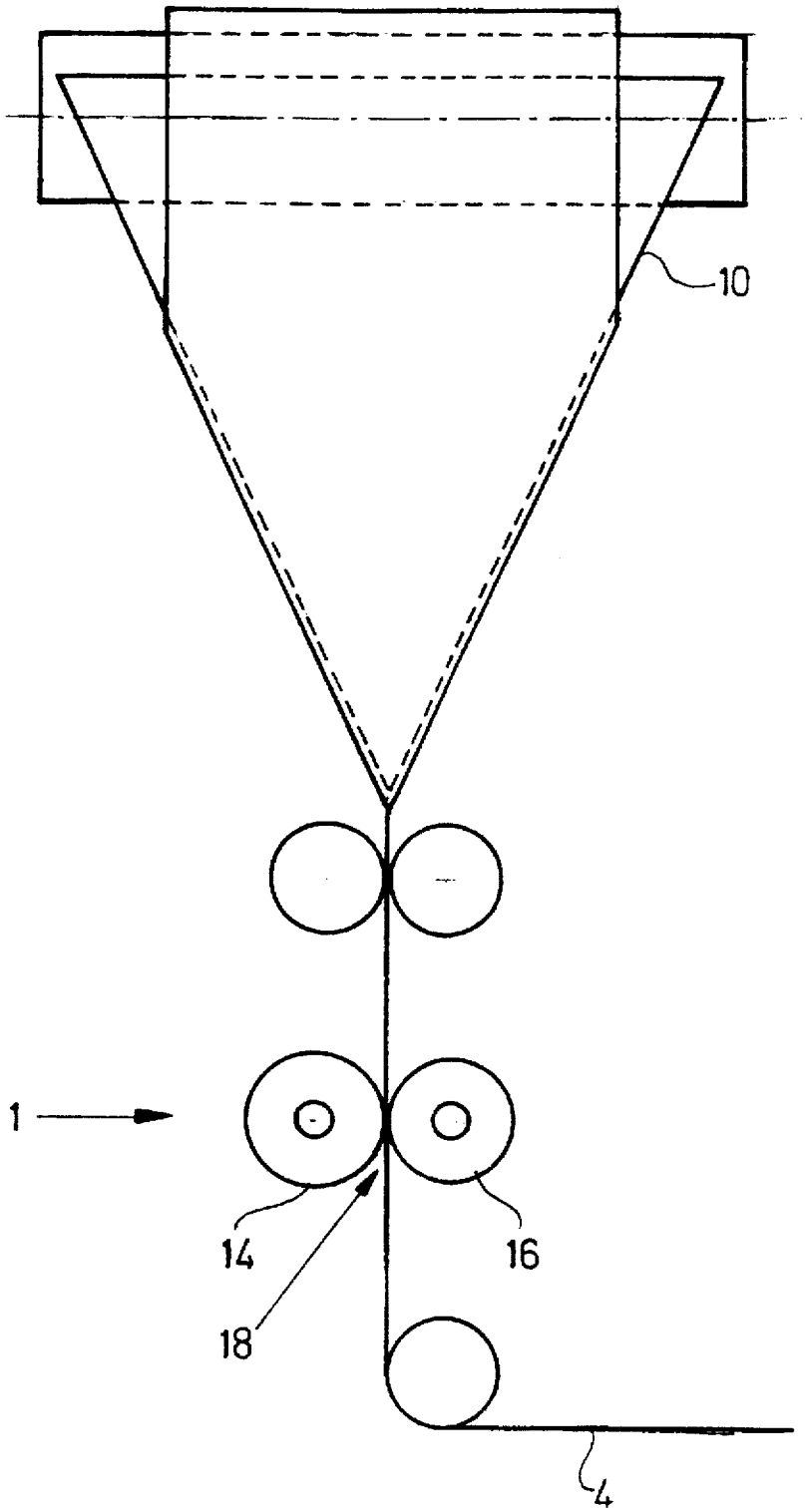
FIG. 2 shows a schematic front view of a former board used in a web-fed rotary printing press for longitudinally folding a printed web, with a nip roller arrangement according to an exemplary embodiment of the present invention located underneath the former board.

As shown in FIG. 2, the nip roller arrangement 1 includes at least a first nip roller 14 and a second nip roller 16, which are arranged on opposite sides of the web 4 (e.g., a printed and folded web), thereby forming a nip 18 for transporting the web 4.

Figure 3:
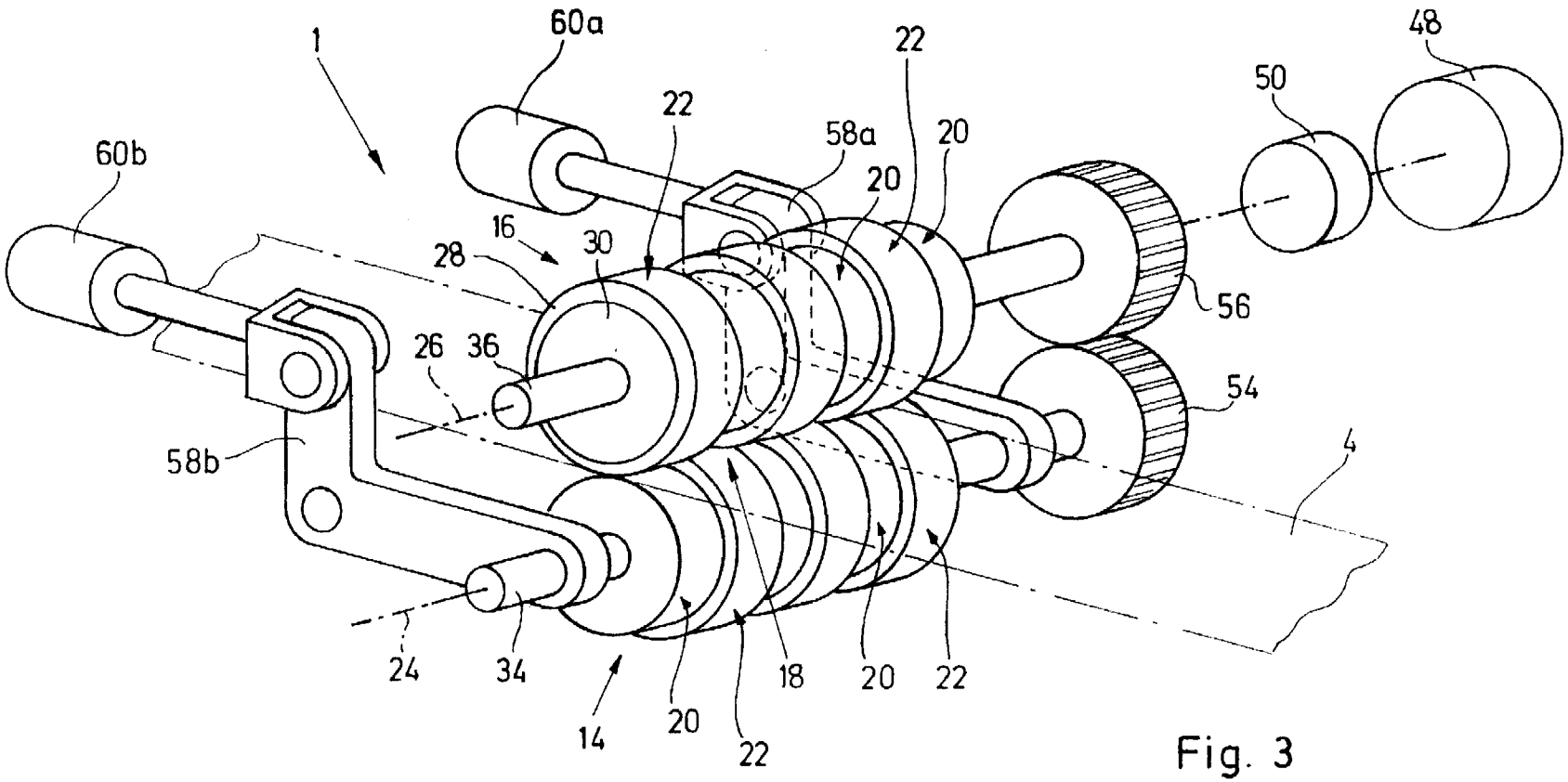
FIG. 3 shows a schematic three-dimensional side view of a nip roller arrangement according to an exemplary of the present invention, wherein the pressure between the nip rollers is adjustable by means of air-cylinders.

As shown in FIG. 3, each of the nip rollers 14 and 16 comprise a first set of driven wheels 20 and a second set of non-driven, free-wheeling wheels 22, the driven wheels and the non-driven wheels being arranged side by side along the rotational axes 24 and 26 of the first and second nip rollers 14, 16, respectively. As can be seen from FIG. 3, the arrangement of the driven and non-driven wheels 20, 22 is such that a driven wheel 20 of one nip roller is facing a non-driven wheel 22 of the other nip roller. That is, for each driven wheel 20 on one roller, there is a corresponding non-driven wheel 22 on the other nip roller, and vice versa.

As shown in the exemplary FIG. 3 embodiment, the central drive shafts 34 and 36 of the first and second nip rollers 14, 16 are drivingly connected to each other by means of meshing gears 54 and 56, mounted to the central drive shafts 34 and 36. In the FIG. 3 embodiment only one of the drive shafts 34, 36 is driven by a motor 48, and the speed of the motor 48 is controlled in dependence on the press speed such that the circumferential speed of the driven wheels 20 of each of the nip rollers 14, 16 equals the surface speed of the material web 4. To control the speed of the nip rollers 14, 16, any known and readily available harmonic drive 50 can, if desired, be provided between the motor 48 and the respective central drive shaft which is driven by the motor 48. As those skilled in the art will appreciate, either or both of the drive shafts can be driven in alternate embodiments.

As shown in FIG. 3, there can further be provided means for moving the two nip rollers 14 and 16 with respect to each other, to adjust the width of the nip 18 between the two nip rollers 14, 16 for transporting and conveying the web material 4. The movement or adjustment of the nip 18 can be performed by a moving means which includes, for example, levers 58*a* and 58*b* and respective air cylinders 60*a*, 60*b*. Of course, any other kind of actuating device, such as electric motors or manual levers can alternately be used.

Figure 5:
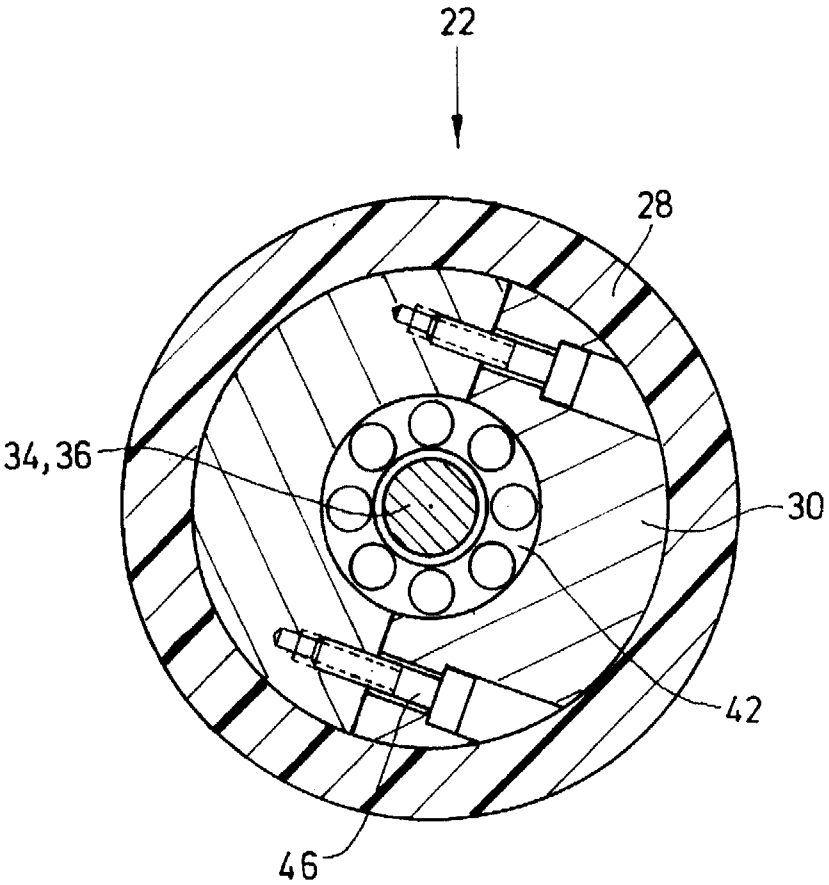
FIG. 5 shows a schematic side view of a non-driven wheel of a nip roller arrangement according to an exemplary embodiment of the present invention.
Figure 4:
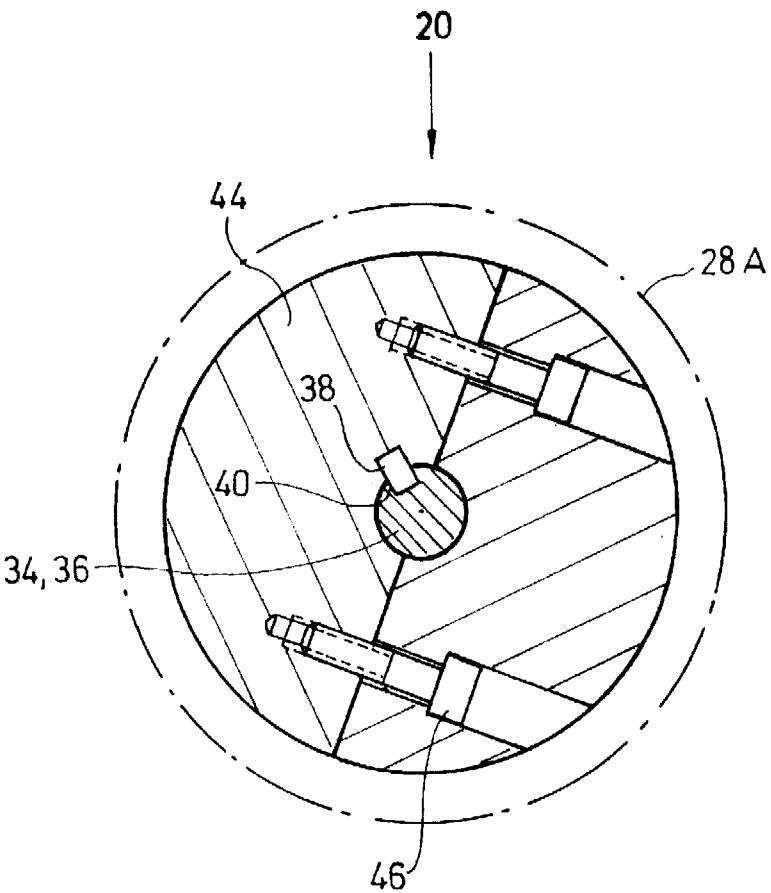
FIG. 4 shows a schematic side view of a driven wheel used in an exemplary nip roller arrangement of the present invention.
Figure 6:
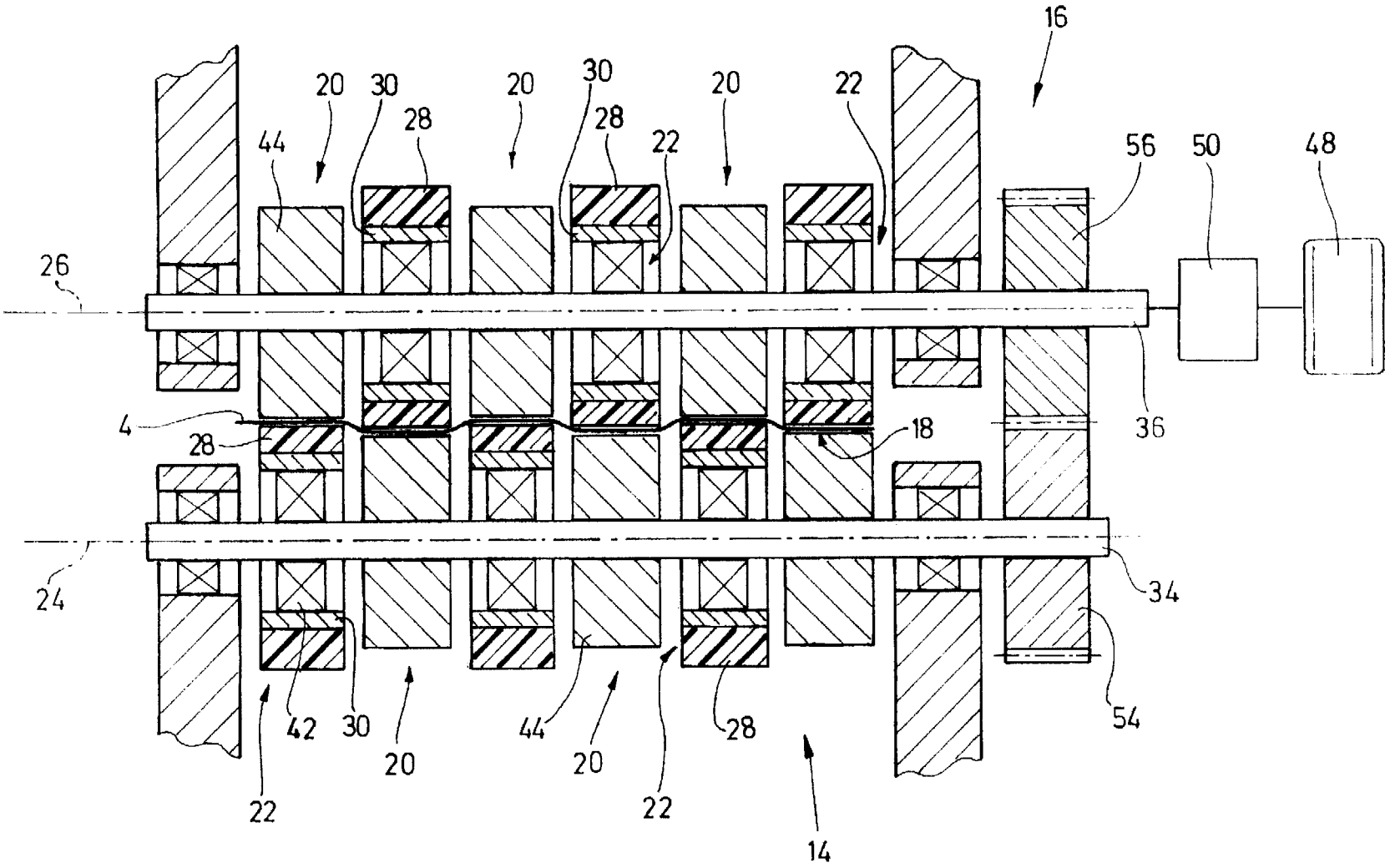
FIG. 6 shows a schematic cross-sectional view of a nip roller arrangement according to an exemplary embodiment of the present invention.

Referring to the exemplary FIG. 4 embodiment of the invention, the driven wheels 20 are formed of a body or core 44 of rigid material, such as metal (e.g., steel or any kind of metal). Further, as illustrated in FIG. 6, the exemplary driven wheels have a slightly smaller diameter than the non-driven wheels 22. As shown in FIG. 5, the non-driven wheels 22 include a rigid core 30 covered with a resilient material (e.g., a bonded material) or coating 28, such as rubber or polyurethane. As shown in the exemplary FIG. 6 embodiment, the coating 28 can be applied to the rigid core or body 30 of the non-driven wheels 22, and although the overall diameter of the non-driven wheels can be the same as or larger than that of the driven wheels in the FIG. 6 embodiment, the core 30 of each non-driven wheel is of a smaller diameter than the diameter of the body 44 of each driven wheel 20. In an alternate embodiment, the non-driven wheels 22 can be entirely formed of a resilient material.

In another embodiment of the invention, both the driven wheels 20 and the non-driven wheels 22 can be formed of a rigid material. Alternately, as indicated by dashed lines in FIG. 4, a resilient coating 28A can be provided on the body 44 of the driven wheels 20 of the first and second nip rollers 14, 16. In such an embodiment, the non-driven wheels 22 can be formed as shown in FIG. 5, or can be formed of a rigid material, such as metal.

In an exemplary embodiment of the invention as illustrated in FIGS. 3–6, each of the nip rollers 14, 16 comprise a central drive shaft 34, 36, respectively extending through the center of the driven and non-driven wheels 20, 22, and being rotatably supported by bearings. As shown in FIG. 4, means are provided for drivingly connecting the driven wheels 20 of each nip roller 14, 16 to a respective one of the drive shafts 34, 36 by, for example, a key 38 and a groove 40 in the drive shaft. The non-driven, free wheeling wheels 22 are, for example, supported on the central drive shafts 34 and 36 by bearings 42, as indicated in FIGS. 5 and 6. To prevent axial movement of the non-driven wheels 22 on the shafts 34, 36, the fitting of the bearings 42 on the shafts can be established with a reasonably tight tolerance, and sleeves can be provided between the driven and the non-driven wheels 20 and 22 for maintaining a defined axial position of the wheels along the length of the shaft.

In an exemplary embodiment of the invention, the core or body 44 of the driven wheels and the core or body 30 of the non-driven wheels 22 can be formed in two parts, which can be clamped together by any clamping means, such as screws 46 of FIGS. 4 and 5. This exemplary configuration of the bodies 44 and 30 of the driven and non-driven wheels 20 and 22 provides easy assembling of the nip rollers 14, 16 and provides for quick replacement of the wheels in the event one or more of the wheels becomes defective.

In an exemplary embodiment of the invention, the pressure between the first and the second nip rollers 14 and 16 is adjusted such that there is no slip between the nip rollers and the surface of the web material 4. As a result of the resilient coating on the driven and/or non-driven wheels 22, the web material 4 comprises a corrugated shape such as shown in FIG. 6, by which the web 4 is stabilized and the web handling in subsequent processing units is improved. The corrugating effect, which is applied to the web 4, depends on the radial thickness of the resilient coating 28 and on the space between a driven wheel 20 and a non-driven wheel 22.

It will be appreciated by those skilled in the art that the present invention can be embodied in other specific forms without departing from the spirit or essential characteristics thereof. The presently disclosed embodiments are, therefore, considered in all respects to be illustrative and not restricted. The scope of the invention is indicated by the appended claims rather than the foregoing description, and all changes that come within the meaning and range and equivalence thereof are intended to be embraced therein.

What is claimed is:

1. Apparatus for transporting web material in a web-fed rotary printing press, comprising:

a first nip roller having a first set of driven and non-driven wheels arranged side by side along a rotational axis of the first nip roller; and a second nip roller having a second set of driven and non-driven wheels arranged side by side along a rotational axis of the second nip roller, the wheels of the first and second nip rollers being arranged such that the driven wheels of said first roller face the non-driven wheels of the second roller to form a nip for receiving and conveying the web material.

2. Apparatus according to claim 1, wherein the non-driven wheels of the first and second nip rollers are coated with a resilient material.

3. Apparatus according to claim 2, wherein the non-driven wheels of the first and second nip rollers are formed, at least in part, of a rigid material.

4. Apparatus according to claim 3, wherein the driven wheels of the first and second nip rollers are formed of a rigid material.

5. Apparatus according to claim 2, wherein the driven wheels of the first and second nip rollers are coated with a resilient material.

6. Apparatus according to claim 2, wherein the resilient material is an elastomer.

7. Apparatus according to claim 1, wherein the non-driven wheels of the first and second nip rollers are formed of a rigid material.

8. Apparatus according to claim 7, wherein the driven wheels of the first and second nip rollers are coated with a resilient material.

9. Apparatus according to claim 7, wherein the rigid material is metal.

10. Apparatus according to claim 1, wherein the driven wheels of the first and second nip rollers are coated with a resilient material.

11. Apparatus according to claim 1, wherein the diameter of the non-driven wheels of the first and second nip rollers is larger than the diameter of the driven wheels.

12. Apparatus according to claim 1, wherein each nip roller further comprises:

a central drive shaft extending through a center of the driven and non-driven wheels; and means for clamping the driven wheels to said central drive shaft.

13. Apparatus according to claim 12, wherein the non-driven wheels of the first and second nip rollers are supported on the central drive shaft of each nip roller by bearings.

14. Apparatus according to claim 12, wherein at least one of the driven and non-driven wheels of the first and second nip rollers are mounted axially immovable on the central drive shaft.

15. Apparatus according to claim 12, wherein the central drive shafts of each of the first and second nip rollers drivingly connected to each other by meshing gears, such that the driven wheels of the first and second nip rollers are driven at essentially the same rotational speed.

16. Apparatus according to claim 1, wherein at least one of the first and second nip rollers is movably supported with respect to the other of the first and second nip rollers, such that a width of the nip for receiving and conveying the web material is adjustable.

17. Apparatus according to claim 1, wherein driven wheels of at least one of the first and second nip rollers are configured to be driven with a circumferential speed essentially equal to a speed with which the web material is conveyed through the nip.

18. Web-fed rotary printing press comprising:

a folder for folding a printed web material;

a first nip roller having a first set of driven and non-driven wheels arranged side by side along a rotational axis of the first nip roller; and a second nip roller having a second set of driven and non-driven wheels arranged side by side along a rotational axis of the second nip roller, the wheels of the first and second nip rollers being arranged such that the driven wheels of said first roller face the non-driven wheels of the second roller to form a nip for receiving and conveying the printed web material.

19. Method for transporting web material in a web-fed rotary printing press while introducing corrugations into the web material, comprising the steps of:

driving a first nip roller having a first set of driven and non-driven wheels arranged side by side along a rotational axis of the first nip roller; and driving a second nip roller having a second set of driven and non-driven wheels arranged side by side along a rotational axis of the second nip roller, the wheels of the first and second nip rollers being arranged such that the driven wheels of said first roller face the non-driven wheels of the second roller to form a nip for receiving and conveying the web material, while introducing corrugations to the web material.

* * * * *